US008556304B2

(12) United States Patent
Chung et al.

(10) Patent No.: US 8,556,304 B2
(45) Date of Patent: Oct. 15, 2013

(54) MULTI POINT DOOR LOCK ASSEMBLY

(75) Inventors: Stanley Chung, San Diego, CA (US); Paul H. Kane, Fife (GB)

(73) Assignee: Union Tool Exporters, Ltd., Taipei (TW)

( * ) Notice: Subject to any disclaimer, the term of this patent is extended or adjusted under 35 U.S.C. 154(b) by 1203 days.

(21) Appl. No.: 12/087,697

(22) PCT Filed: Jan. 10, 2007

(86) PCT No.: PCT/US2007/000700

§ 371 (c)(1), (2), (4) Date: Jul. 11, 2008

(87) PCT Pub. No.: WO2007/082022

PCT Pub. Date: Jul. 19, 2007

(65) Prior Publication Data

US 2009/0165509 A1 Jul. 2, 2009

Related U.S. Application Data

(60) Provisional application No. 60/758,450, filed on Jan. 11, 2006.

(51) Int. Cl.
*E05C 1/02* (2006.01)

(52) U.S. Cl.
USPC ..... 292/137; 70/107

(58) Field of Classification Search
USPC ..... 292/137, 358, 347, 1; 70/149, 107
See application file for complete search history.

(56) References Cited

U.S. PATENT DOCUMENTS

| | | | | |
|---|---|---|---|---|
| 4,055,361 | A * | 10/1977 | Moses | 292/359 |
| 6,393,878 | B1 * | 5/2002 | Fayngersh et al. | 70/107 |
| 6,993,946 | B1 | 2/2006 | Shen | |
| 7,603,880 | B2 * | 10/2009 | Chen | 70/107 |
| 7,871,112 | B2 * | 1/2011 | Kondratuk et al. | 292/137 |
| 2004/0089033 | A1 * | 5/2004 | Lu | 70/107 |
| 2004/0148982 | A1 | 8/2004 | Chiang et al. | |
| 2008/0011029 | A1 * | 1/2008 | Chen | 70/107 |

OTHER PUBLICATIONS

Supplemental European Search Report, 4 pages.

* cited by examiner

*Primary Examiner* — Kristina Fulton
(74) *Attorney, Agent, or Firm* — Patent Law Group LLP; David C. Hsia

(57) ABSTRACT

A multi point door lock device featuring a casing adapted to operatively engage the communicating components of the door lock. A removably engageable latch module slidably engages with the casing. A latch is reversibly engaged into the latch module with an allen screw and allows for user reversal to accommodate different door installations. The latch module also provides a switch for changing between first and second modes of operation to provide an external day latch function. The switching lever protrudes through the face plate on the side of the door.

11 Claims, 10 Drawing Sheets

Latch Operation Switch Position 1 - Back Door Option

Single axis - Split spindle Day Latch operation
Switch Position 2 – Front door option Left Hand Hung Door Configurations 2

Right Hand Hung Door Configurations 1

MULTI POINT DOOR LOCK ASSEMBLY

This application claims the benefit of U.S. Provisional Application Ser. No. 60/758,450, filed on Jan. 11, 2006, which is incorporated herein by reference. The invention herein disclosed and described relates to a door latch or knob operated lock. More particularly it relates to a knob or key operated latching system for a door, having a plurality of different assembly configurations using a latch module, thereby providing adaptability of one such latching mechanism to varying requirements of a plurality of different type door installations and directions of closure.

FIELD OF THE INVENTION

Background of the Invention

Conventional door latches and dead bolts generally are comprised of a knob or key translated locking bolt that projects into the door sash to secure the door in a closed position in the door frame. Generally, latch mechanisms are preassembled to use a knob, or a key, or both, to rotate an axle which in turn translates the locking bolt to recede into the door surface and allow the door to be opened.

Such conventional door latch mechanisms being so configured lack adaptability to the varying requirements of different doors in different venues. Further, such conventional systems lack adaptability for different directions of door rotation into the sash or changing the direction at a later date, thereby increasing the inventory requirements of manufacturers and the assembly and disassembly requirements of users choosing to reverse a door mounting or rotation.

The device herein disclosed features a latch module component that may be reconfigured to allow use on doors in a large number of configurations to match the physical and security requirements of doors located in different venues having different physical and security requirements. Further, a unique switch lever allows the device to operate in reverse of traditional snib operation for such installations. As such, the single piece, multi-point locking door security device disclosed and described herein is adapted to fit into standard Eurogroove form profiles associated with UPvc and composite door systems in varying mounting configurations.

SUMMARY OF THE INVENTION

The device as shown in the drawings features a housing with an internal cavity that provides a casing for internal components. In operation, lifting the door lever engages roller cams and a secondary hook and deadbolt units into one piece or individual pieces to keep it positioned in the fixed door frame and adapted to accept the distal end of the deadbolt or latch. This locks the day latch using a drive rod mechanism. A full turn of the cylinder translates the deadbolt and locks the mechanism. However, this cannot be accomplished unless the lever is lifted first thereafter to return to a horizontal position through sprung action of a split spindle mechanism.

Internal unlocking of the device is accomplished by a full opposite turn of the cylinder which retracts a deadbolt and unlocks the mechanism. In another operation, depression of the lever disengages the roller cams hook bolts and latch from one piece or individual pieces to keep it positioned via drive rod. The lever returns to a horizontal position through sprung action provided by biasing springs located in the split spindle mechanism.

When closed and in registered engagement within the frame, the door is retained on a day latch, which is released by depressing the lever. The day latch can also be released by a ¼ turn of the cylinder whereafter the lever returns to a horizontal position through sprung action in the split spindle mechanism.

External locking of the device is accomplished by lifting the lever wherein a pad engages roller cams and hook bolts into one piece or individual pieces to keep it positioned via a drive rod. A full turn of the cylinder throws a deadbolt and locks the mechanism and the lever will return to the horizontal position through the biasing of the springs in the split spindle mechanism. To provide for external unlocking in one mode, a full opposite turn of the cylinder retracts a deadbolt and unlocks the mechanism.

Depression of the lever disengages the roller cams and bolts and latch from the one piece individual keep but the latch function is dependent on which day latch option is chosen by a rotary trigger mounted on the face plate. When the knob is turned or the lever is depressed, the latch retracts into the lock housing.

The device features an external day latch option providing a first option similar to a single spindle style operation such that when closed, the door is retained on the day latch which is released by depressing the lever. The lever returns to a horizontal position through sprung action in the split spindle mechanism. Also, in a single spindle style operation the day latch can also be released by ¼ turn of the cylinder.

A unique multi-point drive mechanism is provided by the device to activate a drive rail engaged within a groove in the sash. This drive rail activates secondary hook and bolt units linked to the drive rail in addition to throwing a dead bolt in the main central lock unit. Numerous advantages of this multiple point door locking system are provided increasing ease of use and security over single point locking systems which are conventionally available.

Employing a central lock unit independent lever operation is provided by a unique split spindle. This split spindle provides the independent lever action along a single axis. The two individual spindles forming the split spindle employ one spindle attached to an internal lever and other to an external lever positioned in the same plane.

Unlike conventional components, the spindles are not offset to each other and each portion of the split spindle is inserted a substantially equal distance into the central lock unit thereby providing a true 50/50 split. The two spindles forming the split spindle are held in place by respective snap rings located in the central lock unit spindle sockets. The formed split spindle single axis gearbox thereby allows the door fabrication company to use standard door lever hardware instead of customized components.

Also unique in the device, single axis drive gears retain their concentricity by being mounted on a bearing forming a novel dual drive gear mechanism with each drive gear driven by a separate spindle half which is attached to the door levers in an arrangement that allows different functions of external or internal levers.

Especially novel and in the most preferred mode of the device herein, a latch management module is provided which allows the user to switch between first and second options in the external day latch functions. Conventionally a door lock with the option of a second style day latch has a snib facility to hold back the latch which allows the user to regain entry if they exit the door for a short period to get the mail or go outside and such. However, this conventional apparatus and method leaves the door ajar at all times while they are away. With the provided latch management module, the switching lever is on the face plate of the lock instead of one side of the door and the user can switch from the second or temporary exit option to the first option to allow the user to regain entry, whilst the door is closed and on the day latch.

This two option latch solves a market need for the door fabricator to stock one lock and choose whether it will be a back or front door lock. This reduction in stock is provided by the option to employ the switching mechanism of the latch management module situated on the face plate of the lock. This is a major advantage to manufacturers as it allows the fabricator to stock one lock instead of having separate locks for front or back door applications.

Additionally provided in a central lock unit portion is a deadbolt restriction which provides a means of making the deadbolt operate in a compatible fashion with multiple point locking units being activated. This action forces the home owner to have to activate for maximum security. In use a lever must be lifted to throw additional locking points before the cylinder can be activated which controls the dead bolt for translation in and out of the sash when a key is turned through the lock. This provides the additional benefit of separate deadbolt operation from the multipoint locking function.

Finally, providing additional utility is the universal lock function provided by the reversible latch. Through an engagement of a mounting screw or other means of engagement the latch engaged to a forked member may be easily reversed in the assembly by the fabricator enabling the stocking of a single lock for both right hand and left hand mounted doors. This also allows for changes in door swing desired by a user on installation should they wish to swing the doors out instead of inward upon installation or at a later time.

In this respect, before explaining at least one embodiment of the invention herein in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other methods and systems for carrying out the several purposes of the present invention. It is important, therefore, that the claims be regarded as including such equivalent construction insofar as they do not depart from the spirit and scope of the present invention.

It is an object of this invention to provide a multi point door lock assembly with a central latch management module providing the ability to switch lever operations.

It is a still further object of this invention to provide the aforementioned advantages along with a latch and fork member that may be easily reversed thereby decreasing the inventory requirements of manufacturers.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto.

These together with other objects and advantages which will become subsequently apparent reside in the details of the construction and method as more fully hereinafter described and claimed, reference being had to the accompanying drawings forming a part thereof, wherein like numerals refer to like parts throughout.

BRIEF DESCRIPTION OF THE DRAWING FIGURES

Figure 1:
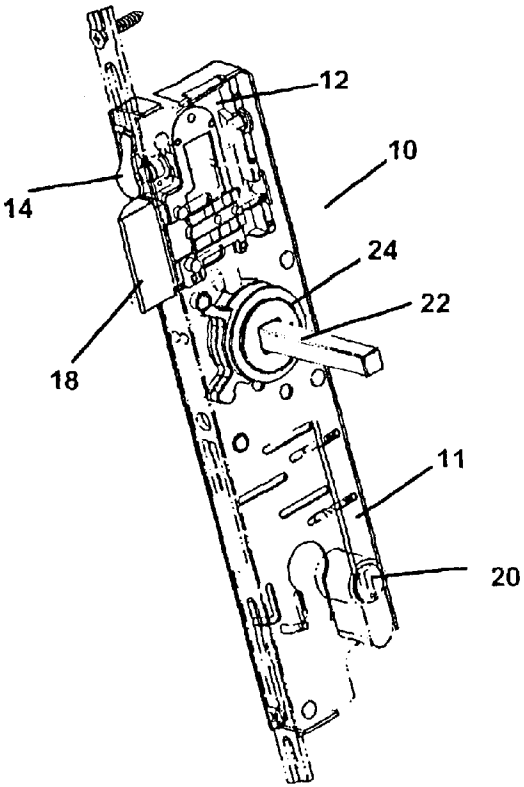
FIG. 1 depicts a perspective view of the latch management module engaged within the casing operatively enclosing the multi point lock.
Figure 2:
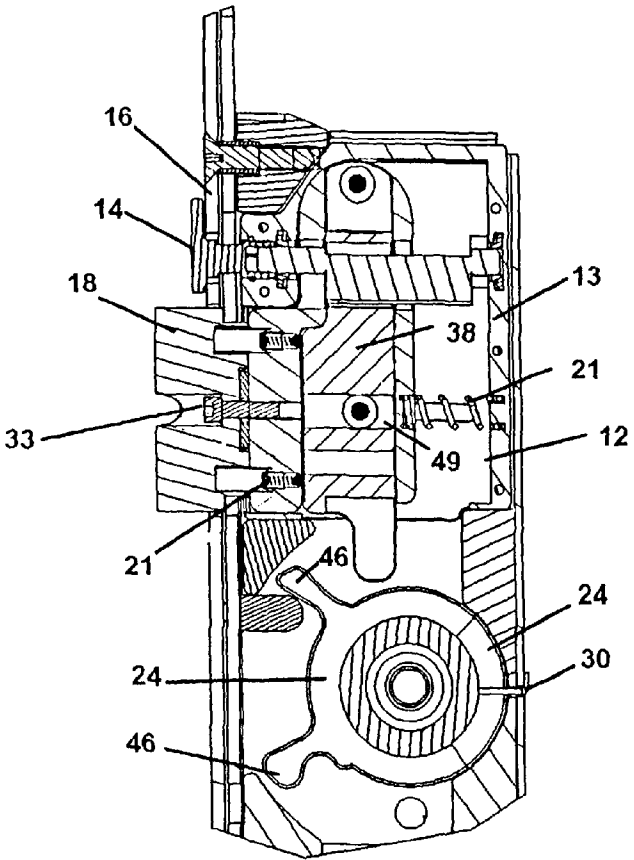
FIG. 2 is a slice through FIG. 1 showing the components of the latch management module and split spindle.
Figure 5:
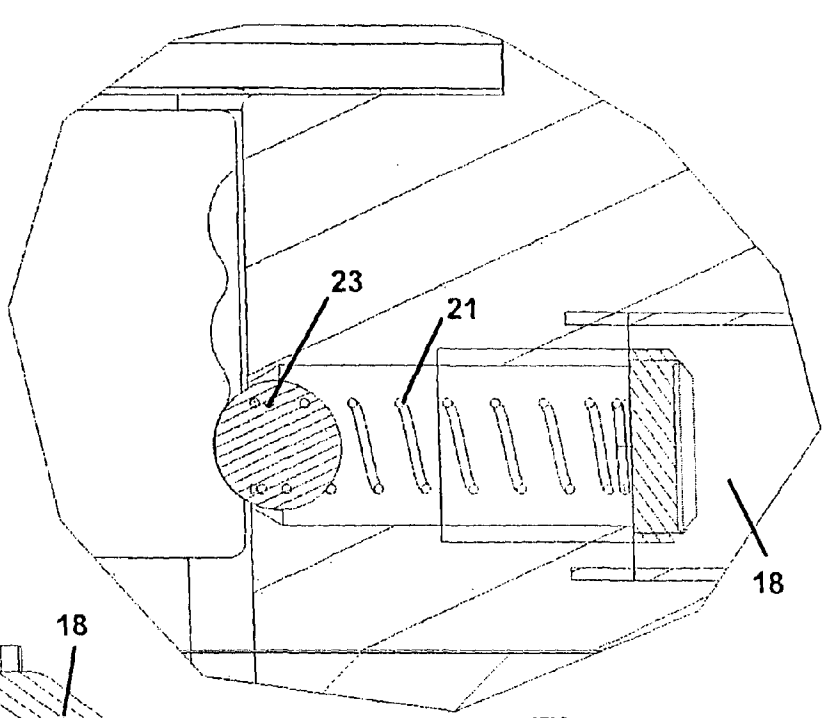
FIG. 5 is an enlarged section showing the biasing components for the latch.
Figure 3:
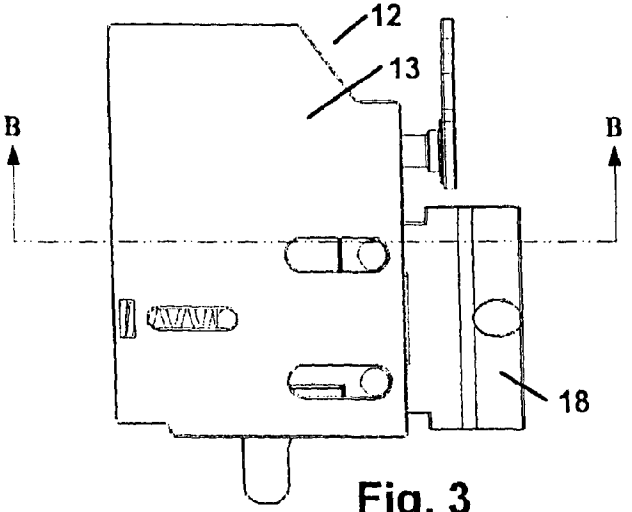
FIG. 3 depicts a side view of the latch management module with the latch and lever extending from a casing.
Figure 4:
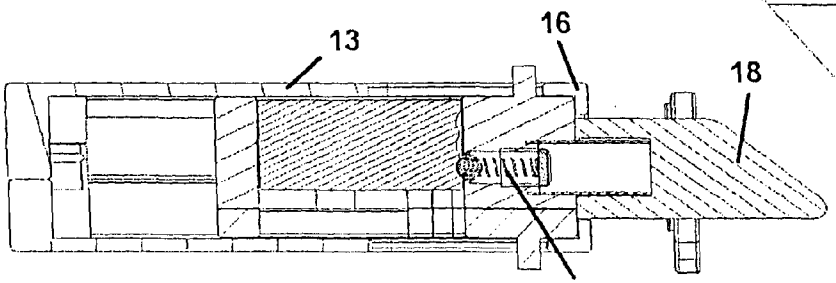
FIG. 4 is a slice through FIG. 3 showing interior components of the latch management module.
Figure 6B:
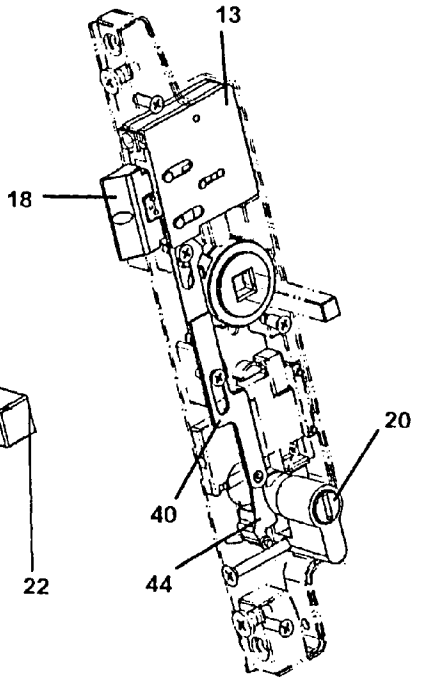
Figure 6A:
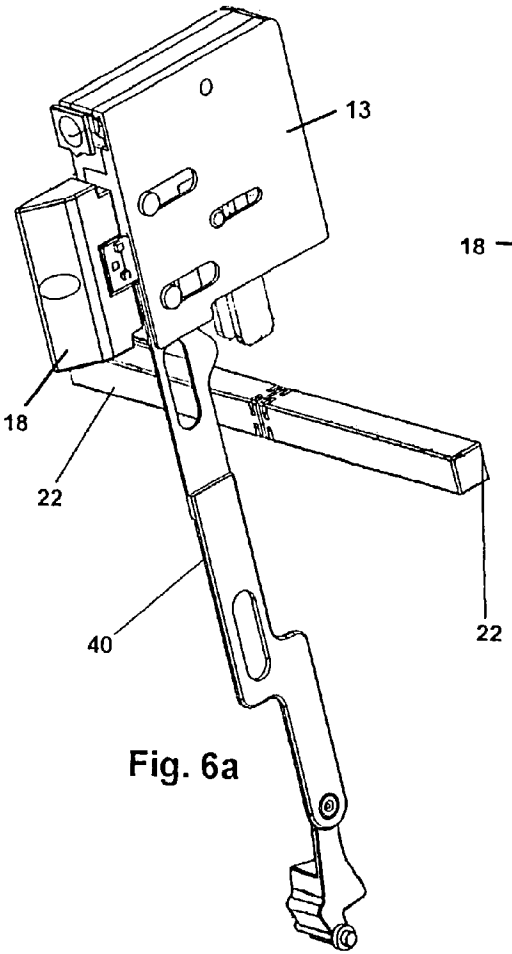

FIG. 6*a* depicts engagement components for the latch management module to the unlocking components of the multi point lock.

FIG. 6*b* shows the lock management module engaged within the multi point lock in a combined structure.

Figure 7:
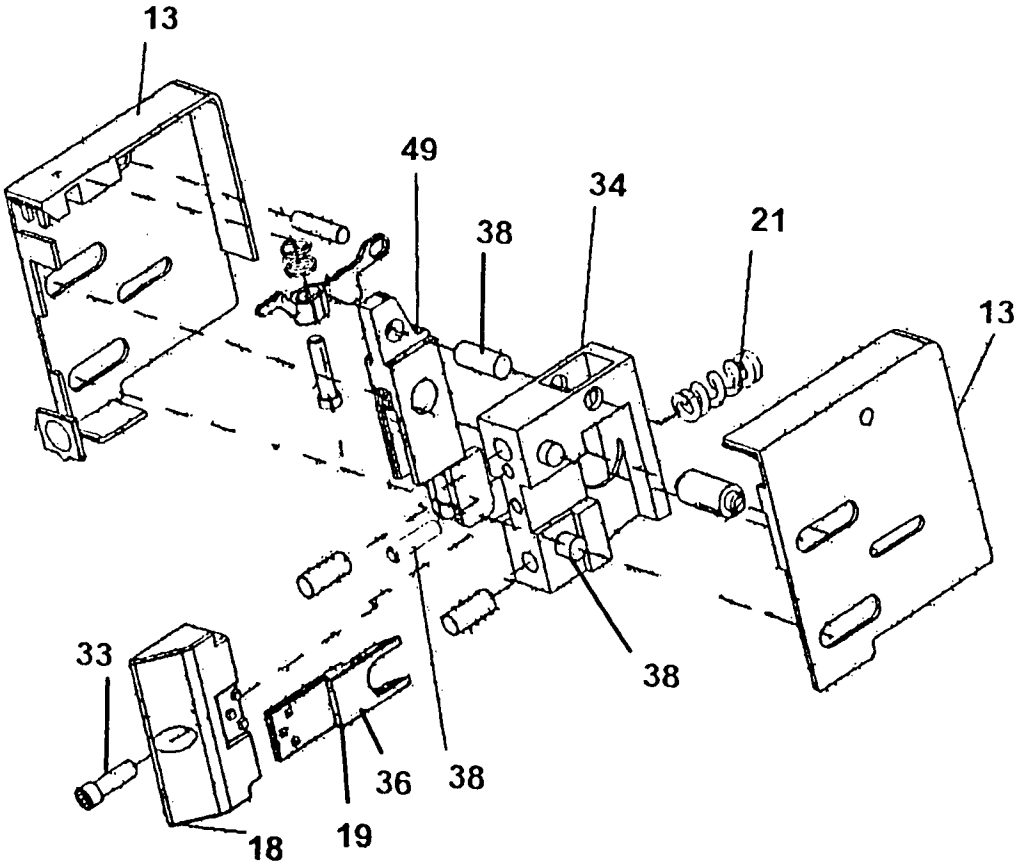

FIG. 7 is an exploded view of interior components of the lock management module showing the reversible latch and fork member.

Figure 10:
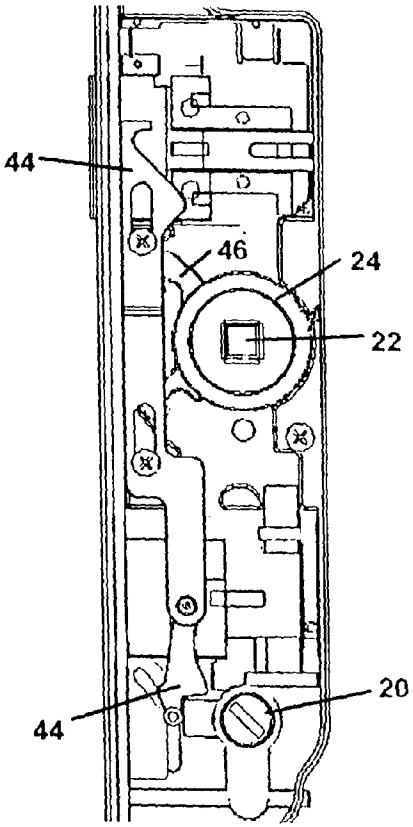
Figure 9:
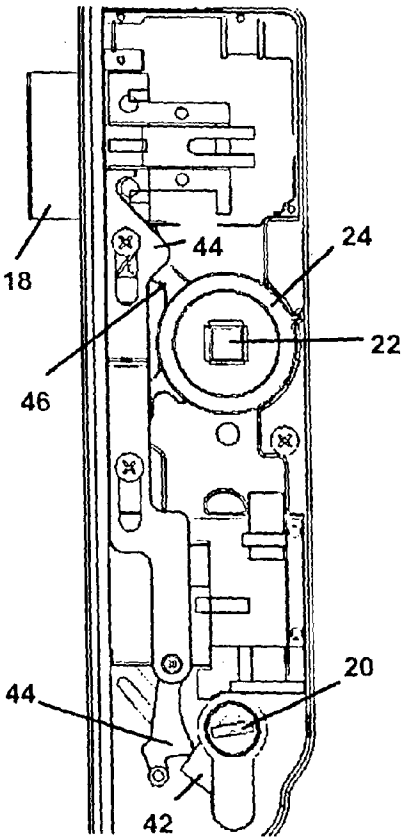
Figure 8:
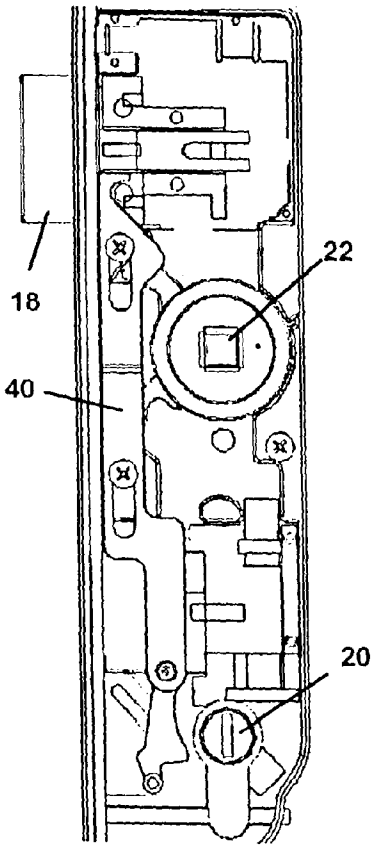

FIGS. 8-10 show operation of the unlocking components engaged to the lock management module.

Figure 11:
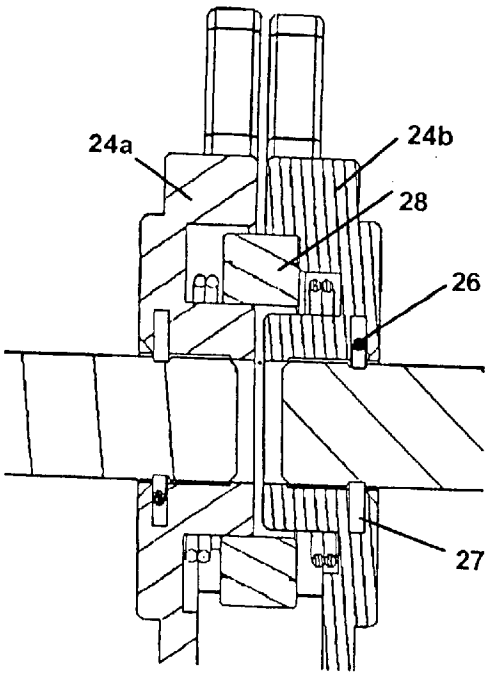

FIG. 11 is a view of the split spindle.

Figure 12:
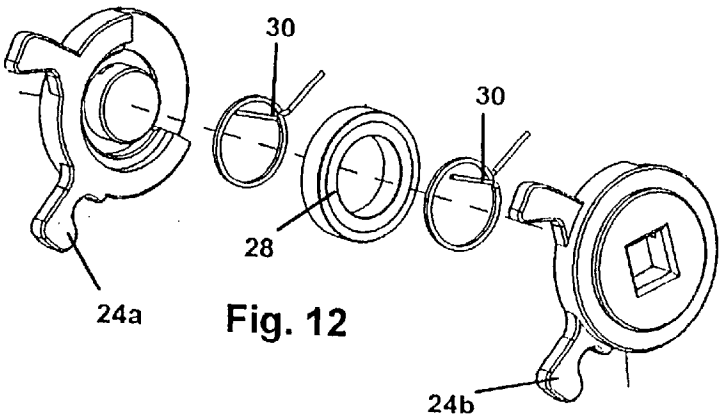

FIG. 12 depicts the two spindle portions aligned along an axis with biasing springs and a bearing.

Figure 13:
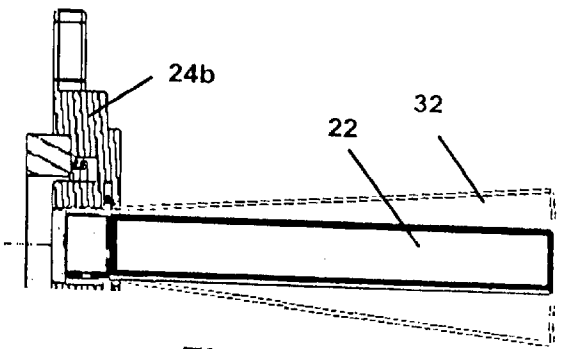

FIG. 13 depicts the deflection provided for the shaft engaging the split spindle.

Figure 14:
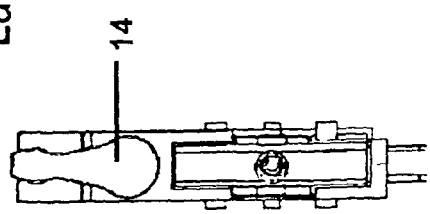
Figure 15:
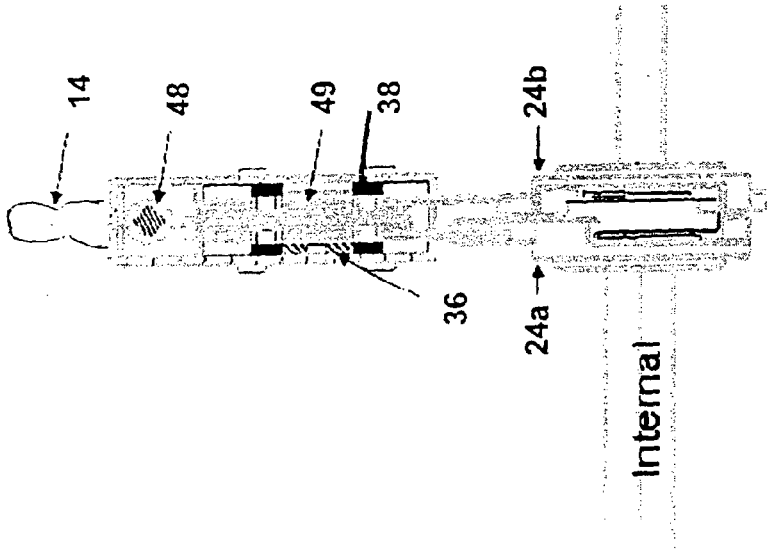
Figure 16:
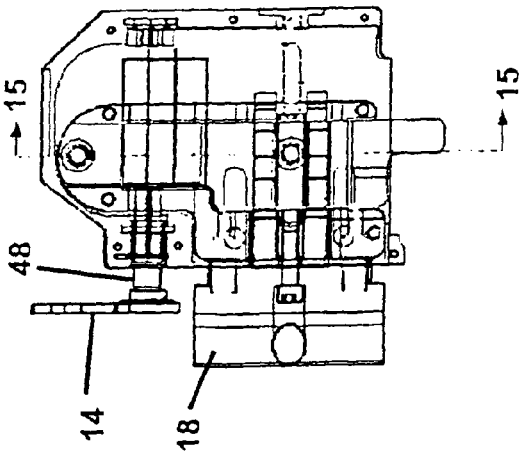

FIGS. 14-16 depict the user configurable latch operation with the switch positioned for a first mode or back door mode.

Figure 19:
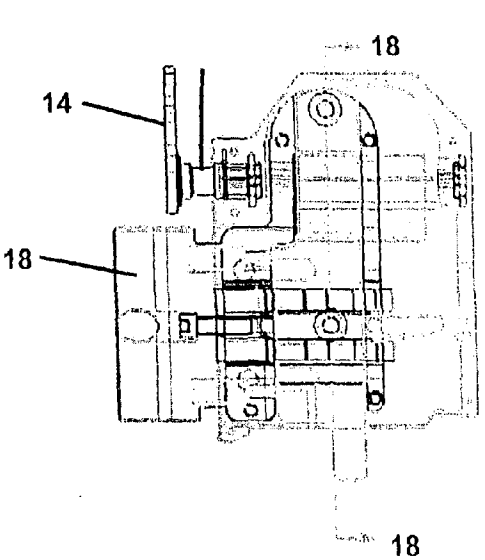
Figure 18:
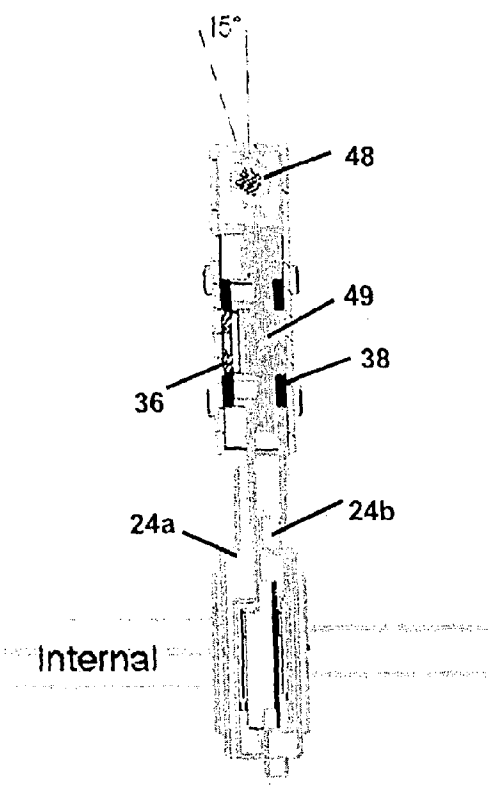
Figure 17:
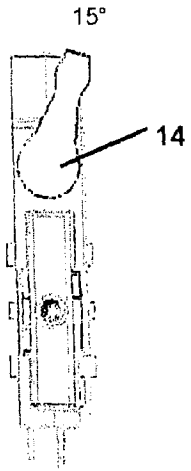

FIGS. 17-19 depict the user configurable latch operation with the switch positioned for the second mode or front door option of operation.

Figure 20:
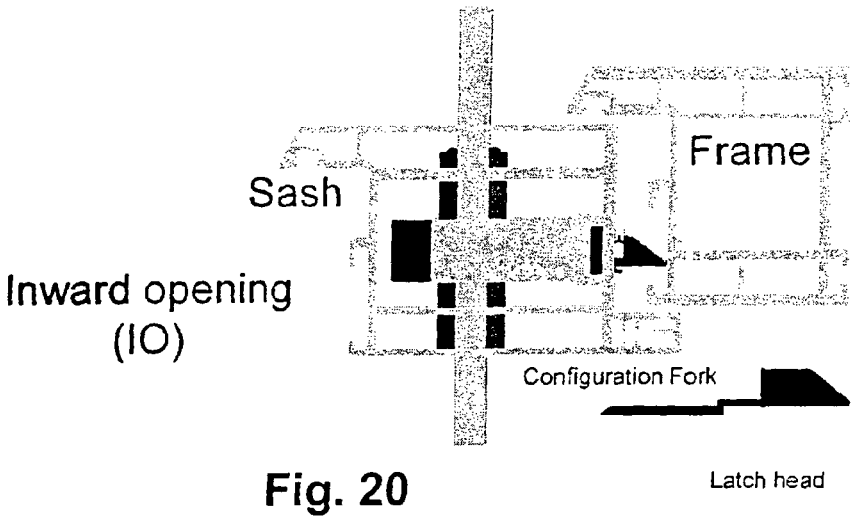
Figure 21:
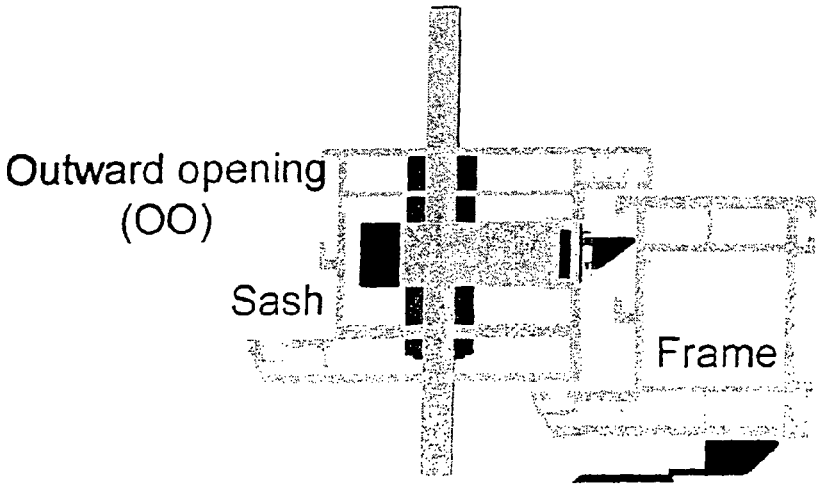

FIGS. 20-21 show left hand configurations of the device.

Figure 22:
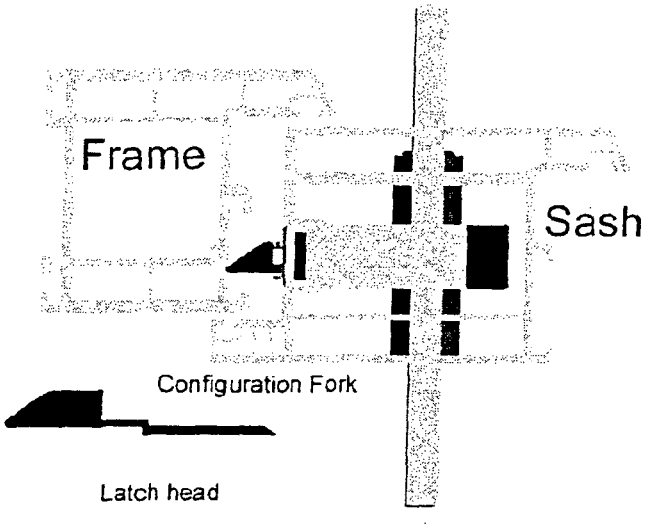
Figure 23:
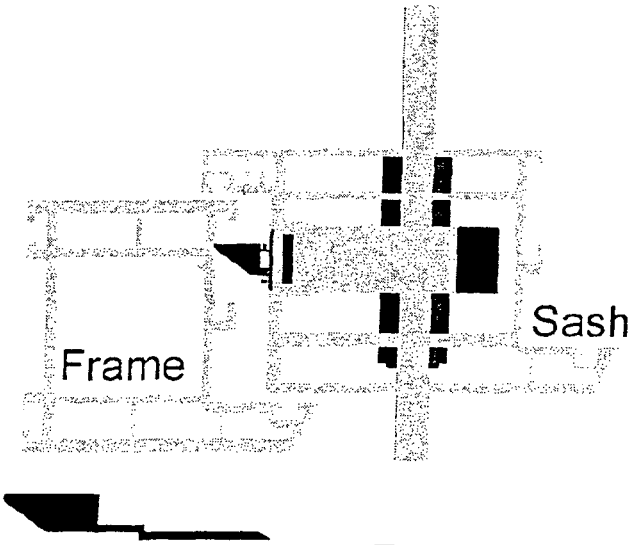

FIGS. 22-23 depict right hand configurations of the device.

DETAILED DESCRIPTION OF THE PREFERRED EMBODIMENTS OF THE DISCLOSED DEVICE

Referring now to the drawings in FIGS. 1-23, the multi point locking device 10 is shown in the current preferred mode in accordance with the present invention having a housing 11 adapted to hold a unique removably engageable latch module 12 that provides for user configuration as to operation once installed, and manufacturer configuration during engagement with a door. The housing 11 is adapted to operatively engage the moving components which engage with conventional door handled and fit in a recess in the side edge of the door.

Provided in a most preferred mode of the device 10 herein, the latch module 12 allows the user to switch between first and second options in the external day latch functions depicted in FIGS. 14-19. The latch module 12, is operatively engaged and housed in a casing 13 adapted for operative engagement with the device 10 as a whole. Protruding from the casing 13 through the face plate 16 is an external lever 14 which rotates to act as a switch to change the mechanical operation of the latch module 12 between first and second modes of operation. This location of the lever 14 through the face plate 16 is especially preferred and novel over conventional snibs which are located adjacent to the handle of the door on an inside surface, since it allows for a single device 10 to function for multiple door installations and is a significant advance over conventional designs where the switch protrudes from a side surface rather than the endwall of the door.

Rotation of the lever 14 will change operation of the lock module 12 to the second mode which is to hold back the latch 18 while the user is outside for a short time. Turning the handle 14 the user can switch from the second or temporary exit option to the first option to allow the user to regain entry, whilst the door is closed and on the day latch. Internally, when the door is closed, but not secured, the door is retained in position by the sprung loaded latch 18 protruding through the casing 13. A conventional spring 21 provides this bias. The latch 18 can be retracted into the casing by depressing the lever 14 or by a third of a turn of the security key 20. In the external option, shown also in FIGS. 14-16, when closed, but not secured, the door is retained in position by the spring 21 biasing the latch 18 protruding through the casing 13. The latch 16 can be retracted into the casing 13 by depressing the lever 14, or by a third of a turn of the security key.

When in a second position as shown in FIG. 1 and FIGS. 17-19, when the door closed, it is again retained on the day latch, which is released by depressing the lever 16 or it can be released by a ⅓ turn of the cylinder by a turn of a handle engaging the shaft 22 or depression thereof.

As noted, the split spindle and latch 18 protruding from the face plate 16 rather than adjacent to the shaft 22, allows fabricators to stock only one device for both front and back doors and still have the day latch function.

An independent lever 22 operation is provided by a unique split spindle 24. This split spindle 24 provides the independent lever action along a single axis. The two individual spindles 24*a* and 24*b* form the split spindle 24 employ one spindle attached to an internal lever and other to an external lever or shaft 22 positioned in the same plane. As noted, the spindles 24 are not offset to each other and each portion of the split spindle 24 is inserted a substantially equal distance into the central lock unit of the device 10 thereby providing a true 50/50 split. The two spindles 24*a* and 24*b* forming the split spindle 24 are held in place by respective snap rings 26 located in the central lock unit spindle sockets 27 and a bearing 28 allows rotation. Springs 30 provide biasing to return the shaft 22 to a static position. The formed split spindle 24 single axis gearbox thereby allows the door fabrication company to use standard door lever hardware instead of customized components. Additionally utility particularly preferred to provide easy alignment is provided by an adaptive shaft 22 engagement to the spindles 24. This engagement at a first end of the shaft 22 provides for an angle 32 of the shaft up to 15 degrees off perpendicular.

Also in the most preferred mode of the device 10 the latch 18 is engaged to a forked member 19. Using an allen screw 33 or other means for engagement, the latch 18 is removably engageable to the latch body 34 with the fork 36 aligned in engagement around protruding pins 38 from the latch body 34. Translation of the latch body 34 thereby moves with the latch 18 and vice versa. The latch 18 with forked member 19 engaged, may be removed from engagement to the latch body 34 and reversed and re engaged with the fork 36 engaged on another pin 38 on the opposite side of the latch body 34. This allows for easy reversal of the latch 18 by the user to change operation of the device 10 for swing direction.

As best shown in FIGS. 8-10 operation to translate the latch body 34 and the latch 18 is accomplished by either rotation of the spindles 24 or a key 20 by employment of an elongated member 40 which is adapted to translate from either rotation of the spindles 24, or rotation of the key 20. As shown in FIG. 8, the member 40 is static and in FIG. 9, a ledge 42 engaged to the rotatable key 20 contacts a cam 44 rotationally engaged to the member 40 at a first end. Continued rotation of the key 20 causes the cam to translate the member 40 and an angled edge 44 on the second end of the member 40 contacts a pin 38 on the latch body 34 causing the latch body 34 and latch 18 to translate. When the shaft 22 is turned, a projection 46 from the spindle 24 communicates translation to the member 40 to achieve the same translation of the latch 18.

The user can switch between the two modes of operation as best shown in FIGS. 14-19. The switching lever 14 in the vertical position as in FIG. 14, allows both the internal and external shafts 22 via spindle 24*a* and 24*b* to make contact with the slide carrier 49. The slide carrier 49 is mounted into the latch body 34 and is located therein by two guide pins 38 similar to the aforementioned pins 38. The slide carrier 49 is held in position in the latch body 38 with the aid of two springs 21 engaged to ball bearings 23 mounted in the latch body 34 which align with the central vertical groove in the slide carrier 49. In this configuration, when either shaft 22 is depressed the corresponding connected spindle 24*a* or 24*b* makes contact with the slide carrier 49 which withdraws the latch 18 in a horizontal direction. The latch body 34 during this withdrawal is working against the bias provided by the springs 21.

The switch lever 14 is rotated clockwise or counter clockwise by about 15 degrees, depending on the location of the fork 36. The switch lever 14 is directly connect to a drive bar 48 which is rotated when the lever 14 is rotated and makes contact with the upper slot in the slide carrier 49 and forces the carrier 49 to be released from the spring loaded ball 23 along the guide pins 38. The carrier's position is maintained within the latch body 34 by the biased ball 23 resting in the outer groove of the carrier 49. In this configuration, only the internal shaft 22 is depressed will the spindles communicate contact with the carrier 49 which thereby withdraws the latch 18. When the external lever is depressed the spindle 24 passes through the carrier and does not withdraw the latch 18.

The fork 36 restricts the travel of the carrier 49 along the guide pins 38. In this configuration the fork 36 may be rotated 180 degrees to provide either the right hand hung or left hand hung applications depending on where it is initially positioned thereby allowing either type of door hanging. The manual lever 14 will still offer dual and single lever operation from the vertical position and when activated in the opposite direction by 15 degrees.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

What is claimed is:

1. A locking apparatus comprising:

a main casing, said main casing having an interior cavity adapted to operatively engage moving components of the locking apparatus;

a split spindle formed of first and second half spindles;

first and second shafts extending to distal ends from engagements with each of a respective of said first and second half spindles, said first and second shafts adapted for door handles;

a latch module having a latch casing, said latch casing having an internal cavity and having exterior dimensioned for engagement within said main casing;

said latch module having a door latch having a proximate end and having an angled leading surface at a distal end;

said proximate end of said door latch engaged with a latch body translatably engaged said internal cavity;

said latch body biased to project said distal end of said door latch from a side surface of said latch module;

a slide carrier communicating at a first end with said split spindle and at a second end with said latch body, the slide carrier comprising first and second legs;

a switching lever being rotatable from a first position to a second position;

a drive bar coupling the switching lever and said slide carrier so a rotation of said switching lever translates said slide carrier; and wherein:

said first and second legs are engaged by said first and the second half spindles when said switching lever is in said first position so a rotation of either of said first or second half spindles causes a concurrent translation of said slide carrier resulting in a translation of said latch body in a direction to cause a retraction of said door latch into said internal cavity;

only said first leg is engaged by said first half spindle when said switching lever is in said second position so only a rotation of said first half spindle causes said concurrent translation of said slide carrier resulting in said translation of said latch body in said direction to cause said retraction of said door latch into said internal cavity.

2. The locking apparatus of claim 1, wherein:

said switching lever projects from said latch module on said side surface adjacent to said distal end of said door latch; and said first position is substantially inline with an axis running along said side surface, and said second position is angled away from said axis.

3. The locking apparatus of claim 2, further comprising:

said first half spindle located on said door on a side outside a room to which said door provides an access; and only said second half spindle located inside said room and communicating said translation to cause said retraction said door latch into said internal cavity, whereby said door latch may only be retracted from said inside of said room.

4. The locking apparatus of claim 3, further comprising:

said first and second shafts engaged respectively to said first and second half spindles to allow for a deflection of said distal ends of said first and second shafts.

5. The locking apparatus of claim 1 additionally comprising:

said door latch having a fastener providing a removable engagement to said latch body;

said fastener being disengageable from said latch body;

whereby a rotation of said door latch is achieved by removing and re-engaging said fastener;

said rotation providing a means to reverse said angled leading surface from facing a first side of said door to facing a second side of said door; and whereby said angled leading surface of said door latch may be positioned for both right and left handed hinge mounting of said door.

6. The locking apparatus of claim 1, further comprising:

said first and second shafts extending from said first and second half spindles along a single axis running therethrough; and said first and second half spindles being substantially in the same plane, whereby conventional door levers and knobs are engageable to said first and second shafts.

7. The locking apparatus of claim 1, further comprising:

each of said first half spindle and said second half spindle being independently rotatable without rotating the other.

8. The locking apparatus of claim 1, wherein said split spindle further comprises:

a bearing, wherein said first half spindle connects to an internal bore of said bearing and said second half spindle connects to an external circumference of said bearing;

a first snap ring located in a first spindle socket defined in said first half spindle, said first snap ring retaining said first shaft to said first half spindle;

a second snap ring located in a second spindle socket defined in said second half spindle, said second snap ring retaining said second shaft to said second half spindle;

a first spring located in a first recess defined in said first half spindle, said first spring being biased to return said first half spindle to a first orientation; and a second spring located in a second recess defined in said second half spindle, said second spring being biased to return said second half spindle to a second orientation.

9. The locking apparatus of claim 8, wherein:

said switching lever is rotatable from said first position to a third position;

only said second leg is engaged by said second half spindle when said switching lever is in said third position so only a rotation of said second half spindle causes said concurrent translation of said slide carrier resulting in said translation of said latch body in said direction to cause said retraction of said door latch into said internal cavity.

10. The locking apparatus of claim 1, wherein said latch casing having said exterior dimensioned for engagement within said main casing in a removable engagement therein.

11. The locking apparatus of claim 1, wherein said main casing is removably engageable in a cavity of a door and said latch module is removably engageable in said main casing to thereby provide said door latch for operative engagement into a cavity in a door sash to provide means for restraint of said door in said sash and means of translation of said door latch into and out of said door sash by rotation of said first and second half spindles.

* * * * *